United States Patent [19]

Gerboth et al.

[11] 4,419,049

[45] Dec. 6, 1983

[54] LOW NOISE CENTRIFUGAL BLOWER

[75] Inventors: Patrick L. Gerboth, Concord Township, Lake County; Stanley E. Jozwiak, Jr., Mentor, both of Ohio

[73] Assignee: SGM Co., Inc., Mentor, Ohio

[21] Appl. No.: 312,884

[22] Filed: Oct. 19, 1981

Related U.S. Application Data

[63] Continuation of Ser. No. 58,856, Jul. 19, 1979, abandoned.

[51] Int. Cl.[3] ..... F04D 29/44

[52] U.S. Cl. ..... 415/206; 415/119; 415/219 B

[58] Field of Search ..... 415/203, 119, 204, 206, 415/207, 219 A, 219 B, 219 C

[56] References Cited

U.S. PATENT DOCUMENTS

| | | | |
|---|---|---|---|
| 801,304 | 10/1905 | Davidson | 415/204 |
| 839,273 | 12/1906 | Davidson | 415/204 X |
| 1,014,321 | 1/1912 | Minor | 415/206 |
| 1,970,855 | 8/1934 | Kaup | 415/119 |
| 2,251,553 | 8/1941 | Redmond | 417/350 |
| 2,258,284 | 10/1941 | Findley | 415/211 |
| 2,710,573 | 6/1955 | Markor | 415/219 O |
| 2,942,773 | 6/1960 | Eck | 415/211 |
| 3,325,089 | 6/1967 | Vogler | 415/207 |
| 3,522,994 | 8/1970 | Zewkner | 415/119 |
| 3,688,867 | 9/1972 | Antonetti et al. | 415/119 |
| 3,824,028 | 7/1974 | Zenker | 415/219 O |
| 3,856,431 | 12/1974 | Tucker | 415/219 C |

FOREIGN PATENT DOCUMENTS

| | | | |
|---|---|---|---|
| 22505 | 8/1912 | Norway | 415/219 B |
| 874110 | 8/1961 | United Kingdom . | |
| 968409 | 9/1964 | United Kingdom . | |
| 1056826 | 2/1967 | United Kingdom . | |
| 1291883 | 10/1972 | United Kingdom . | |
| 1345442 | 1/1974 | United Kingdom . | |
| 1398156 | 6/1975 | United Kingdom . | |

*Primary Examiner*—Harvey C. Hornsby
*Assistant Examiner*—Christine A. Peterson
*Attorney, Agent, or Firm*—Maky, Renner, Otto & Boisselle

[57] ABSTRACT

It has been discovered that by eliminating the cutoff in a centrifugal blower the tone or whistle-like noise usually produced by such blower may be eliminated without unreasonably affecting the performance of the centrifugal blower and in many instances without having any significant effect on such performance. Briefly, the invention is directed to a centrifugal blower and to a particular type of blower housing therefor, in which there is no such cutoff or like impediment to provide the allegedly required transition in the involute wall portion of the blower relatively proximate the blower outlet. Rather, in the present invention an extension wall portion extends from the end of the involute wall portion in a direction toward the blower outlet, preferably terminating at the latter so as to eliminate the conventional blower throat which leads to the blower outlet, with such extension wall portion, or at least a major part thereof, traveling therealong in a direction toward such blower outlet having an increasing radial spacing from the spiral center of the spiral shape housing and/or the radial center of the fan wheel.

2 Claims, 4 Drawing Figures

LOW NOISE CENTRIFUGAL BLOWER

This is a continuation, of application Ser. No. 058,856, filed July 19, 1979 now abandoned.

BACKGROUND OF THE INVENTION

The present invention relates generally, as indicated, to centrifugal blowers and, more particularly, to a means for reducing the noise of a centrifugal blower.

Centrifugal blowers or centrifugal fans (the terms blower and fan being used interchangeably herein) are, of course, well known devices for blowing air, or as desired, other fluids. As is described in the Marks' STANDARD HANDBOOK FOR MECHANICAL ENGINEERS, McGraw-Hill Book Company, New York, 1967, at pages 14–72 through 14–78, a centrifugal fan has a fan wheel and a casing or housing with a cutoff, an air inlet and an air outlet. The fan wheel is of generally cylindrical configuration having blades facing forwad or backward relative to the direction of rotation thereof about the axis of the cylinder. The casing typically is generally spiral in shape to collect the air delivered from the fan wheel and to conduct the same in a spiral flow pattern to the outlet.

An example of a prior art centrifugal blower is illustrated in FIG. 1 of this application. The blower 1 includes a cylindrical fan wheel 2 having a radial center 3 along its axis and a spiral shape blower housing 4 with a blower outlet 5 at one end thereof. The air inlet 6 to the blower 1 is in a side wall 7 to permit air flow into the center of the fan wheel.

The spiral blower housing 4 has an approximate center of curvature or radial center, i.e. the theoretical center of the spiral thereof, not shown, but approximately falling in the vicinity of the radial center 3 of the fan wheel 2. The blower housing 4 has two wall portions which lead generally to the blower outlet 5; one of those wall portions 8 is that part of the spiral shape blower housing that is relatively far or remote from the spiral center, and the other wall portion 9 may be considered the involute wall portion, which generally curves inwardly along the track of the spiral toward the center thereof. Typically the fan wheel 2 is positioned such that it is relatively near the involute wall surface 9, but relatively far from the remote wall portion 8. With the fan wheel 2 so positioned, there is a generally annular spirally expanding flow path along which air may be blown by the rotating fan wheel 2 toward the blower outlet 5 for discharge from the latter in a generally linear flow direction or flow path. Linear is used herein to indicate a non-spirally confined flow path and may be a divergent one, as the air blown through the blower outlet 5 may diverge or expand upon so leaving.

In the past a cutoff 10 has been provided at the end of the involute wall portion 9 relatively proximate or extending into the blower outlet 5. At least part of such cutoff 10 somewhat continues the involute curve of the spiral. According to the above-mentioned text, Marks', such a cutoff is required in a centrifugal blower to provide a transition from the spiral air flow occurring in the housing to the relatively straight-line discharge air flow through the blower outlet 5. In providing such transition, the typical cutoff, such as the cutoff 10 illustrated in FIG. 1, tends to cut off or to impede air flow through the clearance area between the cutoff and the fan wheel 2, which would ordinarily rotate in a counter-clockwise direction relative to the illustration of FIG. 1. As is also described in such text, typically the blower outlet 5 would connect with a duct having a greater height dimension that the height of the blower outlet 5, such greater height dimension being, for example, equal to the distance between the wall portion 8 and the radial center 3 of FIG. 1; and in such case, the cutoff 10 and the throat of restricted flow area section 10' formed by the illustrated wall portion 10'' associated with the cutoff 10 and generally parallel with the wall portion 8 clearly impedes the flow of air into the outlet duct, not shown.

SUMMARY OF THE INVENTION

It has been discovered that the cutoff 10 and throat 10' of a typical conventional centrifugal blower contribute significantly to audible noise, notably an audible tone or whistle-like sound, of such prior art centrifugal blowers. Moreover, in accordance with the present invention, it has been discovered that by eliminating the cutoff and such throat in a centrifugal blower, such tone or whistle-like noise may be eliminated without unreasonably affecting the performance of the centrifugal blower and in many instances without having any significant effect on such performance.

Briefly, then, the invention is directed to a centrifugal blower and to a particular type of blower housing therefor, in which there is no such cutoff, throat or like impediment to provide the allegedly required transition in the involute wall portion of the blower relatively proximate the blower outlet. Rather, in the present invention an extension wall portion extends from the end of the involute wall portion in a direction toward the blower outlet, preferably terminating at the latter, with such extension wall portion, or least a major part thereof, traveling therealong in a direction toward such blower outlet having an increasing radial spacing from the spiral center of the spiral shape housing and/or the radial center of the fan wheel.

Although the total decibel noise level produced by an operating centrifugal blower in accordance with the present invention due to the major air flow therein will not be changed. significantly, the noted tone or whistle-like sound, however, has been significantly reduced or eliminated by practicing the invention in centrifugal blowers.

With the foregoing in mind, it is a primary object of the present invention to provide a centrifugal blower that is improved in the noted respects.

Another object is to reduce or to eliminate the tone or whistle-like noise produced by a centrifugal blower, and especially to effect the same without any significant loss in performance characteristics of the blower.

An additional object of the invention is to provide an effective cylindrical blower without any cutoff or other similar transition from the spiral flow in the blower housing to the straight-line flow in the blower outlet.

These and other objects and advantages of the present invention will become more apparent as the following description proceeds.

To the accomplishment of the foregoing and related ends, the invention, then, comprises the features hereinafter fully described in the specification and particularly pointed out in the claims, the following description and the annexed drawing setting forth in detail a certain illustrative embodiment of the invention, this being indicative, however, of but one of the various ways in which the principles of the invention may be employed.

DESCRIPTION OF THE PREFERRED EMBODIMENT

Figure 1:
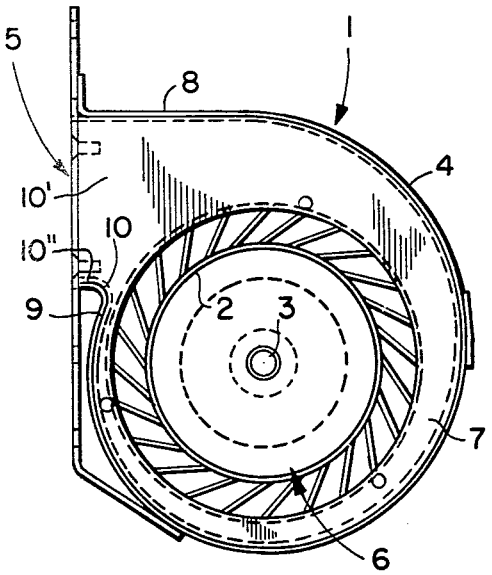
(PRIOR ART) FIG. 1
FIG. 1 is a side elevation view of a prior art cylindrical blower.
Figure 2:
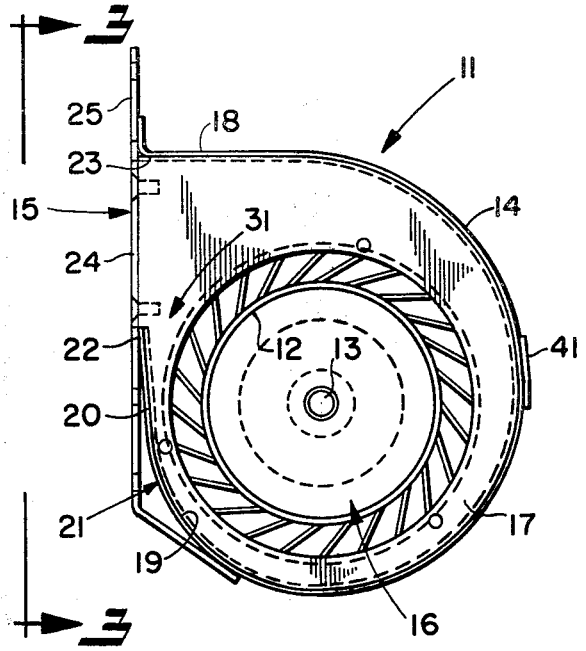
FIG. 2 is a side elevation view of a cylindrical blower in accordance with the present invention.

Referring now in detail to the drawing, wherein like reference numerals designate like parts in the several figures, and initially to FIG. 2, a centrifugal blower in accordance with the present invention is generally indicated at 11. The blower 11 includes a cylindrical fan wheel 12 of conventional design having a radial center 13 along its axis and a generally spiral shape blower housing 14 with a blower outlet 15 at one end of the housing.

The spiral blower housing 14 has an air inlet 16 in side wall 17. A wall portion 18 that is relatively remote or distant from the spiral center of the blower housing 14, which center may be in the vicinity of the radial center 13, extends to the blower outlet 15 forming part thereof. The blower housing 14 also has an involute wall portion 19, which, of course, is more proximate the radial center of the major spiral shape extent of the blower housing 14 than the remote wall portion 18.

Importantly, it will be seen in FIG. 2 that there is no cutoff continuing the general spiral shape of the involute wall portion 19 to provide a transition between the spiral flow and the straight-line or linear flow of air. Rather, an extension wall portion 20, which preferably has a linear extent, leads from its juncture with the involute wall portions 19, say approximately at the area designated 21, up to the blower outlet 15 at the end 22 of the extension wall portion. Thus, it will be seen that there is no impediment in the centrifugal blower 11 similar to the cutoff vane of the prior art centrifugal blower 1. The actual outlet area of the blower outlet 15 may be considered to be the area bounded in part by the end 23 of the remote wall portion 18 and the end 22 of the extension wall portion 20, both of which open into a cutout 24 in a face plate 25 to which the blower housing 14 may be attached, say by spot welding, screws, etc. Moreover, even if the outlet area of the blower outlet 15 were considered to be that bounded by the end 23 of the remote wall portion 18 and the bottom of an outlet duct, not shown, which may line up approximately along a horizontal line drawn through the radial center 13, it will be appreciated that the extension wall portion 20 still will not provide the prior art cutoff transition in which the cutoff shape effectively continues the curve of the spiral of the blower housing 14.

The fan wheel 12 preferably is placed relatively proximate the involute wall portion 19 and relatively remote from the remote wall portion 18 so as to define an annular spirally enlarging space 30 from the area most proximate the closest part of the involute wall portion 19 or extension wall portion 20 to the blower fan wheel 12 traveling in the counterclockwise direction of rotation of the fan wheel toward the blower outlet 15. The exact position for the fan wheel 12 in the blower housing 14 may be determined experimentally or pragmatically in dependence on the desired performance of the centrifugal blower 11. In any event, it will clearly be desirable to have the fan wheel 12 positioned relatively proximate, although with some clearanace therebetween, the involute wall portion 19 and extension wall portion 20 and particularly the juncture area 21 thereof, while, on the other hand, being relatively remote from the remote wall portion 18 and the blower outlet 15.

Since the approximate radial center or spiral center of the spiral shape of the blower housing 14 and the radial center of the cylindrical fan wheel 12 are in the vicinity of one another, it will be seen that the major extent of the extension wall portion 20 in a direction thereof traveling toward the blower outlet 15 has an increasing radial spacing from such center. Therefore, the area 31, which may be referred to as the non-cutoff area since there is no prior art cutoff there, is relatively open and unimpeded between the end 22 of the extension wall portion and the proximate areas of the fan wheel 12. This open area 31 is provided in the centrifugal blower 11 regardless of whether the outer periphery of the fan wheel 12 is more proximate the involute wall portion 19, and particularly the juncture area 21 of the latter with the extension wall portion 20, or is more proximate the extension wall portion 20 at some point along its length, with this relationship being dependent, for example, on the location of the juncture 21 relative to the radial center 13 of the fan wheel and the actual slope of the extension wall portion 20, say, for example, with respect to the vertical. As is illustrated in FIG. 2, the extension wall portion 20 extends generally tangentially to that part of the spiral involute wall portion 19 clearly avoiding a surface discontinuity thereat which could adversely affect air flow there. Also to minimize the cutoff noise effect, as is shown in FIG. 2, the end 22 of the extension wall portion 20 terminates at the face plate 25 in parallel or near parallel relation to the latter.

Figure 4:
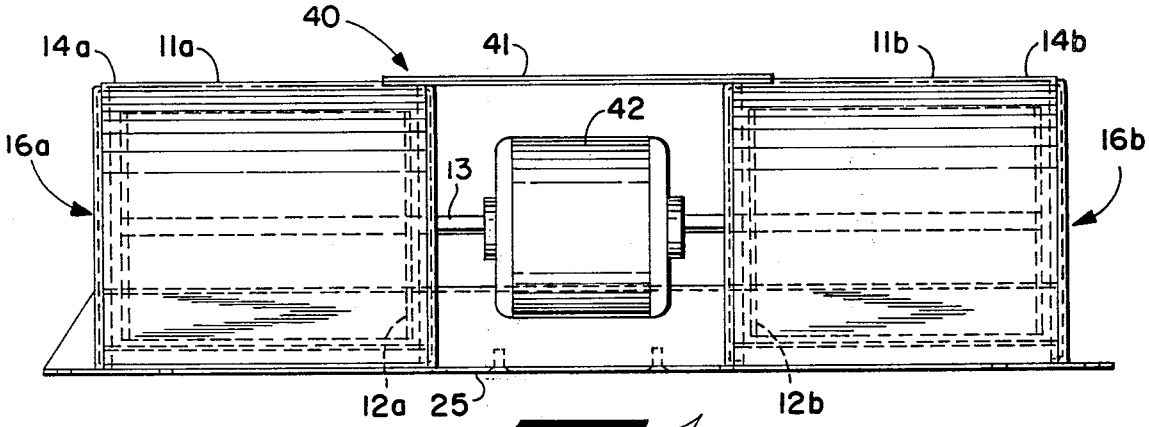
FIG. 4 is a top view of the preferred cylindrical blower looking generally in the direction of the arrows 4—4 of FIG. 3.
Figure 3:
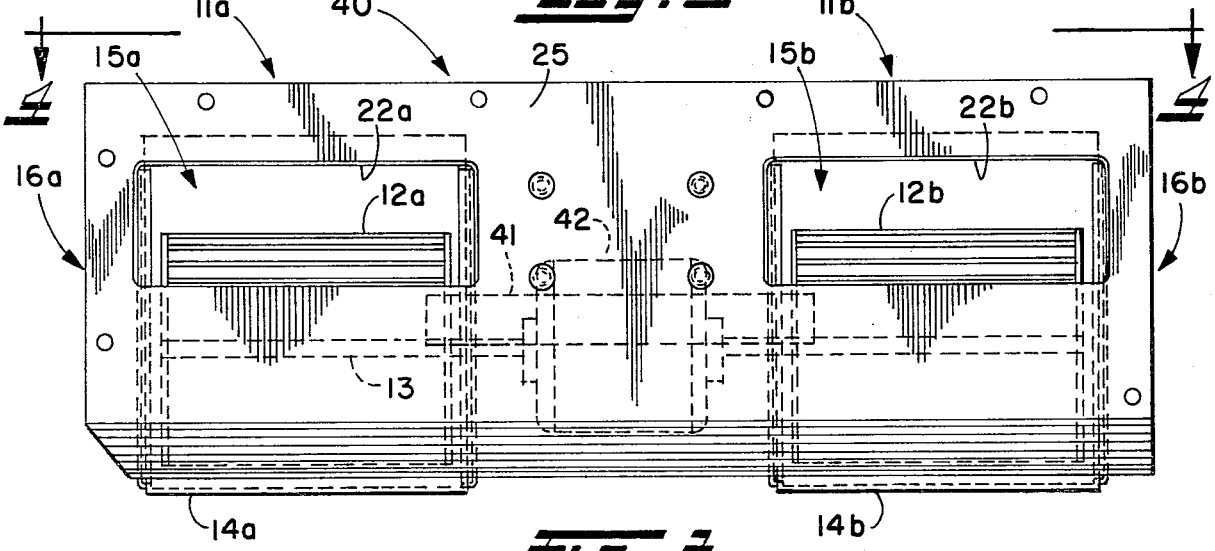
FIG. 3 is a front elevation view of a preferred embodiment of the invention looking generally in the direction of the arrows 3—3 of FIG. 2.

Turning now briefly to FIGS. 3 and 4, in accordance with the best most and perferred embodiment of the invention, a blower assembly 40 may be formed of two centrifugal blowers **11*a*, 11*b* identical with the centrifugal blower 11 described above with reference to FIG. 2. Reference numerals with suffixes a and b designate parts in blowers 11*a*, 11*b* corresponding to those parts designated by similar reference numerals in the blower 11 of FIG. 2. Such blowers 11*a*, 11*b* may be attached to a common face plate 25 and may be further secured by a support strip 41. A single blower motor 42 mounted between blowers 11*a*, 11*b* provides motive force for rotating the two fan wheels 12*a*, 12*b* in the blower housings 14*a*, 14*b*. The air inlets 16*a*, 16*b* may be at opposite ends of the blower assembly 40 and, if desired, one or both of them may open toward the center of the blower assembly 40 to provide a cooling air flow over the motor 42 as air is drawn into the blowers. Air is blown through blower outlets 15*a*, 15*b* of the respective blowers through respective cutouts 22*a*, 22*b* in the face plate 25**.

The blower housing and improved blower of the invention may be used in vehicles and in other environments in which blown air is required.

We claim:

1. A centrifugal blower, comprising generally cylindrical fan wheel means rotatable about its axis for blowing air; housing means for collecting air blown by said fan wheel means, said housing means having a generally spiral shape to direct such collected blown air in a spiral flow path therein, outlet means for receiving such spiral flow of air and for discharging the same from said housing means in a generally straight-line direction, said outlet means comprising a generally planar plate-like member haing a planar cross-section outlet opening therethrough, said housing means having one wall portion terminating relatively far from the spiral center of said housing means, leading to said outlet means, and terminating at said outlet means in generally perpendicular relation thereto, an involute wall portion terminating relatively proximate such spiral center, and an extension wall portion extending from said involute wall portion toward said outlet means, said extension wall portion comprising a linear wall, having an increasing radial spacing from such spiral center in a direction toward said outlet means from at least one of the juncture of said extension wall portion and said involute wall portion and of a location on said extension wall portion otherwise most proximate such spiral center, not having a spiral extending cut-off, having an end terminating at said plate-like member opening in nearly parallel relation to the plane of said plate-like member, whereby said outlet opening is substantially fully open and unimpeded by a throat-like passage, having a major portion positioned with respect to said fan wheel means and said outlet means so as to avoid impeding air flow in said housing means and exiting the latter and said extension wall portion being generally tangential to said involute wall portion at a juncture of said involute and extension wall portions.

2. In a housing for centrifugal blower in which a fan wheel is rotated to blow air, the housing being generally spiral shape having an air inlet, said housing functioning to collect air blown by the fan wheel, the improvement comprising substantially unimpeded outlet means in said housing for discharging at least some of the blown air from said housing, said housing having one wall portion relatively remote from the spiral center and leading toward said outlet means, an involute wall portion relatively proximate such spiral center, and an extension wall portion leading from said involute wall portion to said outlet means, said extension wall portion comprising a generally linear wall positioned with respect to the fan wheel to avoid substantially impeding the blowing of air in said housing, said linear wall having one end coupled to said involute wall portion and a second end opposite said one end, and said outlet means comprising an opening in a plate-like wall exposed directly to the exterior of the blower, and said second end of said linear wall terminating at said plate-like wall, whereby said outlet means is fully open and unimpeded by a throat-like passage and said second end being substantially directionally parallel with the major cross-sectional directional extent of said outlet means.

* * * * *